US011591535B2

(12) United States Patent
Huber et al.

(10) Patent No.: US 11,591,535 B2
(45) Date of Patent: Feb. 28, 2023

(54) ESTOLIDE ESTERS AND USE THEREOF AS A BASE OIL IN LUBRICANTS

(71) Applicant: PETER GREVEN GmbH & Co. KG, Bad Münstereifel (DE)

(72) Inventors: Wilhelm Huber, Kerpen (DE); Hermann Josef Stolz, Bad Münstereifel (DE)

(73) Assignee: PETER GREVEN GmbH & Co. KG, Bad Munstereifel (DE)

( * ) Notice: Subject to any disclaimer, the term of this patent is extended or adjusted under 35 U.S.C. 154(b) by 0 days.

(21) Appl. No.: 17/424,383

(22) PCT Filed: Jan. 23, 2020

(86) PCT No.: PCT/EP2020/051661
§ 371 (c)(1),
(2) Date: Jul. 20, 2021

(87) PCT Pub. No.: WO2020/152286
PCT Pub. Date: Jul. 30, 2020

(65) Prior Publication Data

US 2022/0112439 A1 Apr. 14, 2022

(30) Foreign Application Priority Data

Jan. 23, 2019 (EP) ..... 19153186

(51) Int. Cl.
*C10M 105/42* (2006.01)
*C10N 20/02* (2006.01)
*C10N 30/02* (2006.01)

(52) U.S. Cl.
CPC .... *C10M 105/42* (2013.01); *C10M 2207/301* (2013.01); *C10N 2020/02* (2013.01); *C10N 2030/02* (2013.01)

(58) Field of Classification Search
CPC ..... C10M 105/42; C10M 2207/301; C10M 2207/30; C10N 2020/02; C10N 2030/02; C10N 2030/64; C10N 2030/66
See application file for complete search history.

(56) References Cited

U.S. PATENT DOCUMENTS 5,458,795 A * 10/1995 Lawate ..... C10M 159/08 508/480
8,236,194 B1 * 8/2012 Bredsguard ..... C10M 169/041 252/68
8,450,256 B2 * 5/2013 Bredsguard ..... C07C 69/34 508/465
10,829,436 B2 * 11/2020 Betke ..... C07C 51/36
11,117,854 B2 * 9/2021 Seemeyer ..... C07C 67/08
2011/0282084 A1 * 11/2011 Potula ..... C11C 3/00 554/219
2012/0172269 A1 7/2012 Greaves et al.
2012/0322897 A1 * 12/2012 Bredsguard ..... C10M 105/32 252/68
2013/0053589 A1 * 2/2013 Forest ..... C11C 3/00 554/122
2013/0158277 A1 * 6/2013 Thompson ..... C10M 177/00 554/213
2013/0261325 A1 * 10/2013 Forest ..... C10M 105/40 554/122
2013/0289291 A1 * 10/2013 Nair ..... C07C 67/08 554/172
2013/0324754 A1 * 12/2013 Bredsguard ..... C10M 105/40 554/122
2015/0087570 A1 * 3/2015 Bredsguard ..... C10M 169/04 508/532
2015/0094246 A1 * 4/2015 Bredsguard ..... C10M 169/044 508/506
2016/0229790 A1 * 8/2016 Thompson ..... C10M 105/36
2017/0152209 A1 6/2017 Lutz et al.
2017/0247316 A1 8/2017 Thompson et al.
2018/0216023 A1 * 8/2018 Maier ..... C10M 169/044
2020/0362266 A1 * 11/2020 Byrne ..... C04B 26/18
2021/0047580 A1 * 2/2021 Isbell ..... C10M 129/78
2021/0115352 A1 * 4/2021 Berman ..... C10M 105/40
2021/0230096 A1 * 7/2021 Urata ..... C07C 69/82

FOREIGN PATENT DOCUMENTS

JP H07-228881 A 8/1995

OTHER PUBLICATIONS

Sammaiah et al., "Synthesis and Physical Properties of Novel Estolides from Dicarboxylic Acids and Methyl Ricinoleate: Synthesis and Physical Properties of Novel Estolides", European Journal of Lipid Science and Technology, vol. 118 No. 3, p. 486-494, (Mar. 1, 2016).
International Search Report for corresponding European Patent Application No. PCT/EP2020/051661 dated Aug. 6, 2020.

* cited by examiner

*Primary Examiner* — Ellen M McAvoy
(74) *Attorney, Agent, or Firm* — Christensen Fonder Dardi; Andrew H. Auderieth; Peter S. Dardi

(57) ABSTRACT

Estolide esters obtainable by esterification of —hydroxycarboxylic acids having 12 to 24 carbon atoms, the hydroxycarboxylic acids comprising unsaturated hydroxycarboxylic acids having a) —monocarboxylic acids with 6 to 22 carbon atoms and —polyols with at least two hydroxy groups or b) —monoalcohols having 8 to 22 carbon atoms and —linear carboxylic acids having at least two carboxyl groups or c) —monocarboxylic acids having 6 to 22 carbon atoms and —monoalcohols having 8 to 22 carbon atoms.

19 Claims, No Drawings

ESTOLIDE ESTERS AND USE THEREOF AS A BASE OIL IN LUBRICANTS

CROSS REFERENCE TO RELATED APPLICATIONS

This application is a National Stage filing of PCT Application No. PCT/EP2020/051661 filed Jan. 23, 2020, entitled "Estolide Esters And Use Thereof As A Base Oil In Lubricants", which claims priority to European Patent Application No. 19153186.2, filed Jan. 23, 2019, both of which are incorporated herein by reference.

The present invention relates to estolide esters, the preparation thereof, and the use thereof as a base oil for lubricants, and to such lubricants.

Synthetic esters have been used for decades as base fluids or additives for lubricants. At first, the driving force of this development was concern about the finiteness of the crude oil resources. However, considerations relating to toxicity and biodegradability have increasingly come to play a critical role. The aspect of sustainability is becoming more and more important. Following the example of nature, closed material cycles of regenerable raw materials are to be utilized. An even $CO_2$ balance is one of the critical factors.

Lubricants are supposed to reduce friction between mobile surfaces. The wear between the workpieces is considerably reduced thereby, and excess heat development is prevented. In addition, the lubricants cool the surface and provide for an export of particles.

The different emphasis of these functions is substantially determined by the base fluids of the lubricants. Mineral oils are broadly employed. For the reasons mentioned above, they are increasingly replaced by ester.

Esters have a number of advantages over mineral oils. Because of the polarity of the ester group, they have a high affinity for metal surfaces. This results in good lubricant properties. They have a lower volatility than that of mineral oils, and a high viscosity index, which causes a lower degree of dependence on temperature. The viscosities of the esters can be varied in a broad range by esterification with dicarboxylic acids.

However, esters also have drawbacks. The oxidation stability and thermal stability is not always sufficient for critical applications, especially with some unsaturated esters. Alternatives on the basis of saturated fatty acids mostly show better values, but show worse results in long term cold performance, and often have an insufficient seal tolerance. In addition, the ester linkage is sensitive towards hydrolysis. This has disadvantageous effects, for example, in the production of fats. In many fats, metal soaps are used as thickeners. Lithium or calcium soaps are often employed. The in situ saponification of lithium hydroxide or calcium hydroxide or mixtures thereof with a suitable fatty acid in mineral oil is a common method. This is done at temperatures of more than 200° C. with the addition of water. If esters are used, this method cannot be applied.

Alternatively, the saponification is performed in a mineral oil, followed by filling up with ester oil, or else ready metal soaps are used. Other thickeners, such as polyurea, may also be used.

However, the desired results are often not obtained with these methods. There is still a need for alternative ester oils, which preferably overcome at least one of the mentioned drawbacks.

This object is achieved by estolide esters obtainable by the esterification of hydroxycarboxylic acids with 12 to 24 carbon atoms, said hydroxycarboxylic acids including unsaturated hydroxycarboxylic acids, with a) monocarboxylic acids with 6 to 22 carbon atoms; and polyols with at least two hydroxy groups;

or b)

monoalcohols with 8 to 22 carbon atoms; and linear carboxylic acids with at least two carboxy groups;

or c) monocarboxylic acids with 6 to 22 carbon atoms; and monoalcohols with 8 to 22 carbon atoms.

Thus, the estolide esters according to the invention are obtainable by the esterification of hydroxyacids among themselves. This forms oligomeric or polymeric esters. In addition, either monocarboxylic acids or monoalcohols are contained in the reaction mixture. These serve as "capping agents", preventing further oligomerization or polymerization.

Further, either polyols with at least two hydroxy groups or carboxylic acids with at least two carboxy groups are employed in embodiments a) and b). These serve for further cross-linking in order to increase the degree of oligomerization or polymerization. Such compounds are also referred to as compounding agents.

These are always employed in pairs, i.e., monocarboxylic acids as capping agents with polyols as compounding agents, or monoalcohols as capping agents with polyhydric acids as compounding agents.

In embodiment c), monocarboxylic acids with 6 to 22 carbon atoms are employed together with monoalcohols, thus serving as capping agents.

According to the invention, unsaturated hydroxycarboxylic acids are employed as hydroxycarboxylic acids. It is also possible to employ additional saturated hydroxycarboxylic acids.

Hydroxycarboxylic acids are carboxylic acids that bear at least one hydroxy group but may also bear more than one hydroxy groups.

Preferred lengths of the hydroxycarboxylic acids are 12 to 18 or 12 to 20 carbon atoms. They may be branched-chain or linear.

Preferred examples of such unsaturated hydroxycarboxylic acids include ricinoleic acid, lesquerolic acid, 15-hydroxylinoleic acid, auricolic acid, or hydroxypalmitoleic acid, and mixtures thereof. Ricinoleic acid is particularly preferred.

Preferably, the proportion of unsaturated hydroxycarboxylic acids in the hydroxycarboxylic acids is 10% by weight, more preferably at least 25% by weight, or at least 50% by weight, or at least 80% by weight, or at least 99% by weight.

In a preferred embodiment, the hydroxycarboxylic acids are virtually all unsaturated hydroxycarboxylic acids, within the limits of purity of technical hydroxycarboxylic acids.

As saturated fatty acids, for example, hydrogenated ricinoleic acid, hydroxypalmitic acid, or hydroxydodecanoic acid, or mixtures thereof may be contained.

In one embodiment, monocarboxylic acids with 6 to 22 carbon atoms, preferably from 6 to 18 carbon atoms, are employed as the second component.

Particularly suitable monocarboxylic acids include hexanoic acid, caprylic acid, caprinic acid, pelargonic acid, lauric acid, myristic acid, palmitic acid, stearic acid, oleic acid, linolic acid, linolenic acid, arachidonic acid, and behenic acid, or mixtures thereof. Further, isostearic acids and monomeric acids, in particular, are suitable branched monocarboxylic acids.

Monomer acids are by-products of the production of dimer fatty acids. Dimer fatty acids are produced from different fatty acids by decoction. A fatty acid with conjugated double bonds (conjuenic acid) and further unsaturated fatty acids are necessary. Examples of such fatty acids include conjugated linolic acid. The reaction occurs through a Diels-Alder addition, whereby a partially unsaturated C6 ring is formed. In addition to the dimer, trimers and monomers of the fatty acids may also be present in admixture. Monomer acids are separated from the reaction mixture by distillation.

Polyols are employed as a third component. Polyols are compounds that bear at least two hydroxy groups. As a delimitation from hydroxycarboxylic acids, they must not have a carboxylic acid function. Preferably, the polyols do not contain any β-hydrogen atoms.

Suitable examples of polyols include trimethylolpropane, di(trimethylol)propane, neopentyl glycol, pentaerythritol, dipentaerythritol, monoethylene glycol, (1,2-ethanediol), and mixtures thereof.

In a second embodiment, monoalcohols with 8 to 18 carbon atoms are employed as the second component.

Particular suitable monoalcohols include:

a) octanol, decanol, isotridecyl alcohol, and mixtures thereof;

b) mixtures of 2-alkyl-alcohols obtained by the Guerbet reaction, and mixtures thereof with a).

Polyhydric carboxylic acids, i.e., carboxylic acids with at least two carboxy groups, are then employed as the third component. As a delimitation from hydroxycarboxylic acids, they must not have any hydroxy functions.

Suitable polyhydric carboxylic acids include, in particular, 1,4-butanedioic acid (succinic acid), 1,6-hexanedioic acid (adipic acid), 1,9-nonanedioic acid (azelaic acid), and 1,10-decanedioic acid (sebacic acid), and mixtures thereof.

In some preferred embodiments, the monocarboxylic acids or monoalcohols (capping agents) are branched-chain, or at least there are branched-chain compounds contained in a mixture.

In some preferred embodiments, the carboxylic acids with at least two carboxy groups or polyols (compounding agents) are branched-chain, or at least there are branched-chain compounds contained in a mixture.

In some preferred embodiments, both compounding agents and capping agents are branched-chain, or at least there are branched-chain compounds contained in a mixture.

As the molar ratio of hydroxycarboxylic acids to monocarboxylic acids or monoalcohols (or to the sum of monocarboxylic acids or monoalcohols) in variant c)), a range of 3:1 to 1:1 has proven suitable.

As the molar ratio of hydroxycarboxylic acids to polyols, a ratio of 12:1 to 2:1, preferably 7:1 to 2:1, has proven suitable.

The estolide esters according to the invention typically have a viscosity of at least 80 $mm^2/s$ at 40° C. If monoalcohols and monoacids according to variant c) are exclusively used, the estolide esters according to the invention typically have a viscosity of at least 40 $mm^2/s$ at 40° C.

The invention also relates to a process for preparing the estolide esters according to the invention, comprising the steps of the esterification of hydroxycarboxylic acids with 12 to 24 carbon atoms, said hydroxycarboxylic acids including unsaturated hydroxycarboxylic acids, with a)

monocarboxylic acids with 6 to 22 carbon atoms; and polyols with at least two hydroxy groups;

or b)

monoalcohols with 8 to 22 carbon atoms; and linear carboxylic acids with at least two carboxy groups;

or c)

monocarboxylic acids with 6 to 22 carbon atoms; and monoalcohols with 8 to 22 carbon atoms.

The invention further relates to the use of the estolide esters according to the invention as a base oil for lubricants, and to a lubricant comprising an estolide ester according to the invention.

Preferably, such lubricants comprise other additives selected from the group consisting of antioxidants, defoamers, extreme pressure additives, wear inhibitors, and pour point depressants. The invention is further illustrated by the following Examples.

EXAMPLE 1: SYNTHESIS OF AN ESTOLIDE TMP ESTER WITH A C8/C10 FATTY ACID (ISO-VG 150)

105.4 g of a C8/C10 fatty acid mixture (58:42% by weight) and 200 g of ricinoleic acid are charged in a three-necked flask with an intensive cooler and thermometer, and esterified at 180-250° C. under 100-250 mbar, until the hydroxyl number of the reaction mixture is <30 mg of KOH/g. The mixture is cooled down, and 30.0 g of 1,1,1-trimethylolpropane and 0.1 g of SnO as a catalyst are metered in. Subsequently, the product is esterified at 185-220° C. and under 100-250 mbar until the acid number is <2 mg of KOH/g. After removing the catalyst, the ester is obtained with a viscosity of about 150 $mm^2/s$.

EXAMPLE 2: SYNTHESIS OF AN ESTOLIDE NPG ESTER WITH A C8/C10 FATTY ACID (ISO-VG 68)

105.8 g of a C8/C10 fatty acid mixture (58:42% by weight) and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 54.1 g of 2,2-dimethylolpropane and 0.1 g of SnO as a catalyst are metered in. Subsequently, the product is esterified at 185-220° C. and under 100-250 mbar until the acid number is <2 mg of KOH/g. After removing the catalyst, an ester is obtained with a viscosity of about 70 $mm^2/s$.

EXAMPLE 3: SYNTHESIS OF AN ESTOLIDE TMP ESTER WITH A C8/C10 FATTY ACID (ISO-VG 320)

75.4 g of a C8/C10 fatty acid mixture (58:42% by weight) and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 28.5 g of 2,2-dimethylolpropane and 0.1 g of SnO as a catalyst are metered in. Subsequently, the product is esterified at 180-220° C. and under 10-100 mbar until the acid number is <2 mg of KOH/g. After removing the catalyst, the ester is obtained with a viscosity of about 320 $mm^2/s$.

EXAMPLE 4: SYNTHESIS OF AN ESTOLIDE ITD ESTER WITH ADIPIC ACID (ISO-VG 100)

233.9 g of isotridecyl alcohol and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 62.5 g of adipic acid (1,6-hexanedioic acid) and 0.1 g of SnO as a catalyst are metered in. Subsequently, the product is esterified at 180-220° C. and under 10-100 mbar until the acid number is <2 mg of KOH/g. After removing the catalyst, an ester is obtained with a viscosity of about 100 $mm^2/s$.

EXAMPLE 5: SYNTHESIS OF AN ESTOLIDE MEG ESTER WITH ISOSTEARIC ACID (ISO-VG 100)

399.7 g of isostearic acid and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 50.3 g of monoethylene glycol and 0.1 g of SnO as a catalyst are metered in. Subsequently, the product is esterified at 180-220° C. and under 10-100 mbar until the acid number is <2 mg of KOH/g. After removing the catalyst, an ester is obtained with a viscosity of about 100 $mm^2/s$.

EXAMPLE 6: SYNTHESIS OF AN ESTOLIDE ITD ESTER WITH ISOSTEARIC ACID (ISO-VG 46)

399.7 g of isostearic acid and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 285.9 g of isotridecyl alcohol and 0.1 g of SnO as a catalyst are metered in. Subsequently, the product is esterified at 180-220° C. and under 10-100 mbar until the acid number is <2 mg of KOH/g. After removing the catalyst, an ester is obtained with a viscosity of about 46 $mm^2/s$.

EXAMPLE 7: SYNTHESIS OF AN ESTOLIDE TMP ESTER WITH ISOSTEARIC ACID (ISO-VG 220)

399.7 g of isostearic acid and 333.1 g of ricinoleic acid are charged in a three-necked flask with an intensive cooler and thermometer, and esterified at 180-200° C. under 100-250 mbar, until the hydroxyl number of the reaction mixture is <30 mg of KOH/g. The mixture is cooled down, and 66.8 g of TMP and 0.1 g of SnO as a catalyst are metered in. Subsequently, the product is esterified at 180-220° C. and under 10-100 mbar until the acid number is <2 mg of KOH/g. After removing the catalyst, an ester is obtained with a viscosity of about 225 $mm^2/s$.

Determination of the Hydrolytic Stability According to ASTM D2619

The determination of the hydrolytic stability of the estolides was effected according to ASTM D2619. The difference of the acid numbers before and after the test was used as the measured quantity. The values for the estolides according to Examples 1 to 3 were compared with complex esters of the respective ISO VG classes.

The values stated in Table 1 were obtained.

Determination of the Pour Point

The pour point of the estolides was determined in accordance with ISO 3016:1994. Estolides according to the invention and those of adipic and dimer fatty acids were compared. Here too, the values for the estolides according to Examples 1 to 3 were compared with complex esters of the respective ISO VG classes.

The values stated in Table 1 were obtained.

| Viscosity class (ISO VG) | Polyol | Carboxylic acid | Fatty acids | Hydrolytic stability [mg of KOH/g] | Pour point [° C.] |
|---|---|---|---|---|---|
| 150 (Example 1) | TMP | caprylic/ caprinic acid | ricinoleic acid | 0.04 | −36 |
| 150 (Comparative Example) | TMP | adipic acid | oleic fatty acid | 0.2 | −30 |
| 68 (Example 2) | NPG | caprylic/ caprinic acid | ricinoleic acid | 0.05 | −51 |
| 320 (Example 3) | TMP | caprylic/ caprinic acid | ricinoleic acid | 0.22 | −36 |
| 320 (Comparative Example) | TMP | dimer fatty acid | oleic fatty acid | 0.21 | −30 |
| 100 (Example 4) | ITD | adipic acid | ricinoleic acid | 0.32 | −45 |
| 100 (Example 5) | MEG | isostearine | ricinoleic acid | 0.06 | −24 |
| 46 (Example 6) | ITD | isostearine | ricinoleic acid | 0.01 | −36 |
| 220 (Example 7) | TMP | isostearine | ricinoleic acid | 0.05 | −42 |

The invention claimed is:

1. An estolide ester obtainable by the esterification of hydroxycarboxylic acids with 12 to 24 carbon atoms, said hydroxycarboxylic acids including unsaturated hydroxycarboxylic acids, wherein the esterification comprises:

a)
- reacting the unsaturated hydroxycarboxylic acids with monocarboxylic acids having 6 to 22 carbon atoms to form an estolide; and
- reacting the estolide with polyols having at least two hydroxy groups to form an estolide ester comprising linked estolides;

or b)
- reacting the unsaturated hydroxycarboxylic acids with monoalcohols having 8 to 22 carbon atoms to form an estolide; and
- reacting the estolide with linear carboxylic acids having at least two carboxy groups to form an estolide ester comprising linked estolides;

or c)
- reacting the unsaturated hydroxycarboxylic acids with monocarboxylic acids having 6 to 22 carbon atoms to form an estolide; and
- reacting the estolide with monoalcohols having 8 to 22 carbon atoms to form an estolide ester wherein hydroxyl groups and carboxylic acid groups esterify to form the estolide ester with unsaturated bonds.

2. The estolide ester according to claim 1, wherein said unsaturated hydroxycarboxylic acids contain one or more double bonds.

3. The estolide ester according to claim 1, wherein said hydroxycarboxylic acids contain one or more hydroxy groups.

4. The estolide ester according to claim 1, wherein said monocarboxylic acids or said carboxylic acids with at least two carboxy groups are saturated or unsaturated monocarboxylic acids.

5. The estolide esters according to claim 1, wherein said hydroxycarboxylic acids have 12 to 18 carbon atoms.

6. The estolide ester according to claim 1, wherein the molar ratio of hydroxycarboxylic acids to polyols or carboxylic acids with at least two carboxy groups is within a range of from 12:1 to 2:1.

7. The estolide ester according to claim 1, wherein the molar ratio of hydroxycarboxylic acids to monocarboxylic acids or monoalcohols is within a range of from 3:1 to 1.1.

8. The estolide ester according to claim 1, wherein said polyols are polyhydric alcohols without any β-hydrogen atoms.

9. The estolide ester according to claim 1, wherein said polyols are selected from trimethylolpropane, di(trimethylol)propane, neopentyl glycol, pentaerythritol, dipentaerythritol, isotridecanol, 2-alkyl-alcohols (Guerbet alcohols), and mixtures thereof.

10. The estolide ester according to claim 1, wherein said unsaturated hydroxycarboxylic acids are selected from ricinoleic acid, lesquerolic acid, 15-hydroxylinoleic acid, auricolic acid, or hydroxypalmitoleic acid, or mixtures thereof.

11. The estolide ester according to claim 1, wherein said monocarboxylic acids are selected from hexanoic acid, caprylic acid, caprinic acid, pelargonic acid, lauric acid, myristic acid, palmitic acid, stearic acid, oleic acid, linolic acid, linolenic acid, arachidonic acid, behenic acid, isostearic acids, monomer acids, and mixtures thereof.

12. The estolide ester according to claim 1, wherein said carboxylic acids with at least two carboxy groups are selected from 1,4-butanedioic acid (succinic acid), 1,6-hexanedioic acid (adipic acid), 1,9-nonanedioic acid (azelaic acid), and 1,10-decanedioic acid (sebacic acid), and mixtures thereof.

13. The estolide ester according to claim 1, wherein said monoalcohols are selected from octanol, decanol, isotridecyl alcohol, 2-alkyl-alcohols obtained by the Guerbet reaction, and mixtures thereof.

14. The estolide ester according to claim 1, wherein the viscosity is at least 40 $mm^2/s$ at 40° C., or at least 100 $mm^2/s$ at 25° C.

15. A process for preparing estolide esters according to claim 1, comprising a)

reacting hydroxycarboxylic acids with 12 to 24 carbon atoms, said hydroxycarboxylic acids including unsaturated hydroxycarboxylic acids, with monocarboxylic acids having 6 to 22 carbon atoms to form an estolide; and reacting the estolide with polyols having at least two hydroxy groups to form an estolide ester comprising linked estolides;

or b)

reacting hydroxycarboxylic acids with 12 to 24 carbon atoms, said hydroxycarboxylic acids including unsaturated hydroxycarboxylic acids, with monoalcohols having 8 to 22 carbon atoms to form an estolide; and reacting the estolide with linear carboxylic acids having at least two carboxy groups to form an estolide ester comprising linked estolides;

or c)

reacting hydroxycarboxylic acids with 12 to 24 carbon atoms, said hydroxycarboxylic acids including unsaturated hydroxycarboxylic acids, with monocarboxylic acids having 6 to 22 carbon atoms to form an estolide; and reacting the estolide with monoalcohols having 8 to 22 carbon atoms to form an estolide ester, wherein hydroxyl groups and carboxylic acid groups esterify to form the estolide ester with unsaturated bonds.

16. A lubricant comprising an estolide ester according to claim 1.

17. The estolide ester according to claim 1, wherein reacting the unsaturated hydroxycarboyxlic acids is performed at a selected temperature range between about 150° C. and about 300° C., reacting hydroxycarboxylic acids with monoalcohols proceeds until the hydroxyl number is less than about 50 mg of KOH/g, and reacting the estolide is performed in the presence of a catalyst.

18. The estolide ester according to claim 1, wherein the pour point is from −20° C. to −55° C.

19. The process according to claim 15, wherein reacting the unsaturated hydroxycarboxylic acids is performed at a selected temperature range between about 150° C. and about 300° C., reacting hydroxycarboxylic acids with monoalcohols proceeds until the hydroxyl number is less than about 50 mg of KOH/g, and reacting the estolide is performed in the presence of a catalyst.

* * * * *